US005192898A

United States Patent [19]

Dossot et al.

[11] Patent Number: 5,192,898

[45] Date of Patent: Mar. 9, 1993

[54] DEFLECTION YOKE WITH RINGING SUPPRESSION MEANS

[75] Inventors: Alain Dossot, Chevigny Saint Sauveur; Jean-Pierre Fourché, Dijon, both of France

[73] Assignee: Videocolor, Paris la Defense, France

[21] Appl. No.: 710,880

[22] Filed: Jun. 6, 1991

[51] Int. Cl.[5] ..... H01J 29/56

[52] U.S. Cl. ..... 315/370; 335/213

[58] Field of Search ..... 315/370; 335/213

[56] References Cited

U.S. PATENT DOCUMENTS

| | | | |
|---|---|---|---|
| 3,792,305 | 2/1974 | Lister | 335/213 |
| 4,088,930 | 5/1978 | Barten | 315/370 |
| 4,511,871 | 4/1985 | Schier, Jr. et al. | 335/210 |
| 5,008,600 | 4/1991 | Hashimoto et al. | 315/370 |
| 5,039,922 | 8/1991 | Ogasa et al. | 315/370 |

FOREIGN PATENT DOCUMENTS 57-33560 7/1982 Japan .

*Primary Examiner*—Theodore M. Blum

*Attorney, Agent, or Firm*—Joseph S. Tripoli; Joseph J. Laks; Sammy S. Henig

[57] ABSTRACT

This invention relates to a deflection arrangement for a video display of color pictures. The arrangement comprises a deflection yoke including a pair of vertical deflection coils toroidally wound on a magnetic core, using a multi-layer terminal technique. An R-C network is coupled between an intermediate terminal of the firstly wound layer of one of the coils and between an intermediate terminal of the firstly wound layer of the other one of the coils. The R-C network suppresses ringing in the coils that are produced by a horizontal deflection coil during horizontal retrace.

6 Claims, 3 Drawing Sheets

DEFLECTION YOKE WITH RINGING SUPPRESSION MEANS

This invention relates to a deflection arrangement for a video display.

To provide deflection of the electron beams in a cathode ray tube (CRT) of a television receiver, a deflection yoke comprising vertical and horizontal windings is mounted over the neck of the CRT. For a saddle-toroid (ST) or hybrid yoke, the horizontal winding comprises two saddle shaped coils that are placed into a nonmagnetic saddle shaped housing with the coils being symmetrically disposed about the horizontal axis and plane. The vertical winding typically comprises two coils, each coil toroidally wound around an upper or a lower half, respectively, of a toroidal core. After the winding is completed, each core piece is placed against the outside of the saddle shaped housing, with each of the vertical coils being symmetrically disposed about the vertical axis and plane.

The vertical deflection coil is situated in the horizontal deflection field that is produced by the horizontal deflection coil. Therefore, during horizontal retrace, a fast transition in the horizontal deflection field may induce, by magnetic coupling, a corresponding voltage pulse in each of the vertical deflection coils. Each vertical deflection coil includes a capacitance between its winding turns and a self-inductance. The capacitance forms with the self-inductance of the vertical deflection coil a resonant circuit that is excited by the induced pulse during horizontal retrace and that may produce current ringings in the vertical deflection coil following horizontal retrace. The ringings have an amplitude that, typically, decays during the following horizontal trace. Such ringings are undesirable because they may produce visual artifacts in the left side of the picture displayed on the faceplate of the CRT.

Each vertical deflection coil may be formed by wire turns being toroidally wound on the magnetically permeable ferrite core with the wire being carried by a flyer of a winding machine. In some prior art deflection yokes, in which the horizontal deflection current is at a frequency $f_H$, that is 15.7 KHZ in the NTSC standard, the winding turns of each of the vertical deflection coils are wound in a progressive manner.

In the progressive manner winding technique, all the wire turns in the vicinity of each angular position on the toroidal core are wound consecutively. After all the wire turns in a given angular position are wound, wire turns in an adjacent angular position are wound. A change in the angular position from each angular position to its corresponding adjacent angular position occurs progressively and substantially only in one angular direction around the circular perimeter of the core, from the beginning to the end of each coil. Thus, in the progressive manner winding technique, the wire that forms the wire turns is not returned backward, for example, to its starting point throughout the winding process of the coil.

In one prior art vertical deflection yoke having a vertical deflection coil, that is believed to be wound in the above-mentioned progressive manner winding technique, an R-C network is coupled between first and second intermediate terminals or taps, of the first and second vertical deflection coils, respectively. The first and second vertical deflection coils are wound on the upper and lower halves, respectively, of the core. The first intermediate terminal is coupled between end terminals of the first vertical deflection coil such that a first portion of the first vertical deflection coil is coupled between the first intermediate terminal and one of the end terminals and a second portion of the first vertical deflection coil is coupled between the first intermediate terminal and the other one of the end terminals. Similarly, the second intermediate terminal is coupled between end terminals of the second vertical deflection coil. It is believed that the R-C network is used there for suppressing the ringings. However, such arrangement may not be sufficient to suppress ringings produced in a vertical deflection coil wound in the progressive manner winding technique and in which the frequency of the horizontal deflection current is at, for example, $2 \times f_H$.

It is well known that in a vertical deflection coil wound with a multiple layer winding technique, the ringings induced in each vertical deflection coil during horizontal retrace are substantially less objectionable than those induced in each vertical deflection coil having the same number of winding turns but wound in the progressive manner winding technique. In the multiple layer winding technique, each of the vertical deflection coils is formed as a plurality of layers, such as 5 layers. In contrast to the progressive manner winding technique, in the multiple layer winding technique, after a given layer of wire turns is completely wound around the core, the wire is returned backward, for example, to or close to its starting point and a subsequent layer of wire turns is wound over the preceding one. After each layer is wound, the wire may be returned to its starting point by, for example, a shootback method in which the return wire follows a generally direct path along the outside of the core. This winding process continues until all the layers of the coil are wound.

Typically, the direction of the vertical deflection field is angularly rotated at an electron beam exit portion of a typical deflection yoke relative to an electron beam entrance portion of the yoke. This rotation is referred to as a spiral winding effect. The spiral winding effect occurs because, in order to simplify the winding process, the winding turns in the vertical deflection coil are wound in a nonradial manner. Assume a first deflection yoke having a horizontal deflection coil driven by a horizontal deflection current at the frequency $f_H$. The first deflection yoke is adapted to provide horizontal and vertical deflection in a CRT. Also assume that the number of winding layers in each vertical deflection coil of such deflection yoke, for example, five winding layers, is selected to provide ringings at an acceptable magnitude. Assume a second deflection yoke that can provide deflection in a similar type of CRT but that has a horizontal deflection coil driven at the frequency $2 \times f_H$.

Should the number of winding layers selected for forming the vertical deflection coil of the aforementioned second deflection yoke so as to suppress the ringings be substantially larger than in the first vertical deflection yoke, the spiral winding effect will be substantially different in the two yokes. This is so because the different number of winding turns in each layer requires a different winding "pitch". Because of the different spiral winding effects, should the number of winding layers be different in the vertical deflection coils of the first and second deflection yokes, a CRT that is adapted by a lensing process to operate with the first deflection yoke may not be suitable for operation with the second deflection yoke. It may be desirable to reduce a difference between the CRT lensing required for operation with the first and second deflection yokes. This is so in order, for example, to utilize the same type CRT with any of the first and second deflection yokes. By utilizing the same type of CRT with each of the deflection yokes, a cost reduction is obtained. Therefore, it may be desirable to maintain the number of winding layers in a given vertical deflection coil of the first deflection yoke, for example, the same as in that of the second deflection yoke. It follows that it may be desirable to reduce the ringings in the second deflection yoke without resorting to using a larger number of winding layers in the vertical deflection coil of the second deflection yoke than in that of the first deflection yoke.

A deflection yoke embodying an aspect of the invention for producing electron beam scanning in a cathode ray tube of a video display includes a core made of a permeable magnetic material. A first vertical deflection coil cooperates with the core for producing a vertical deflection field. The first vertical deflection coil has a plurality of winding layers wound around the core in a multiple layer winding technique. A horizontal deflection coil produces a horizontal deflection field. A ringing suppressing impedance is coupled to an intermediate terminal between end terminals of the first vertical deflection coil for suppressing ringings that are produced in the first vertical deflection coil by the horizontal deflection field.

Figure 1:
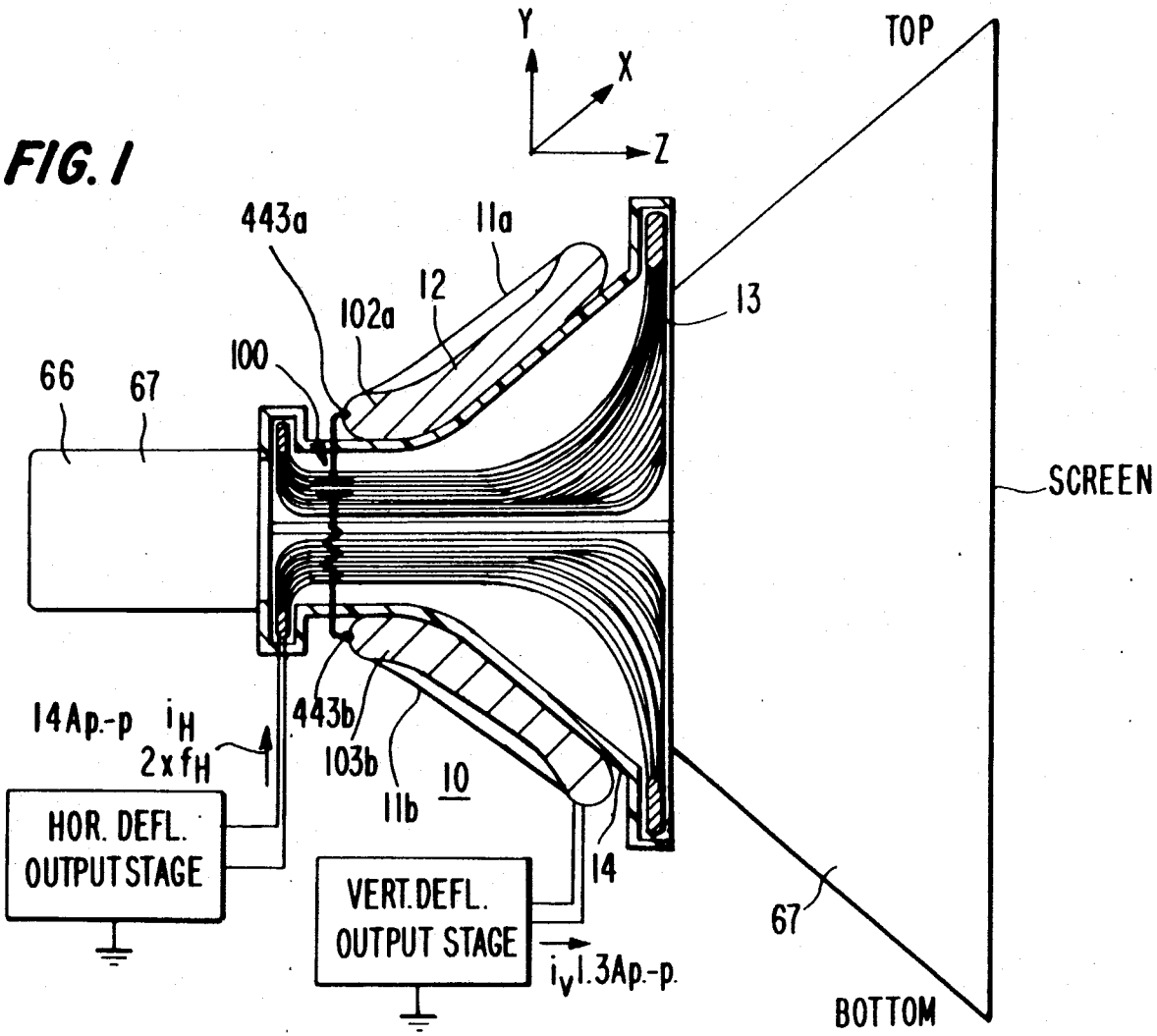
FIG. 1 illustrates a cross section of a deflection yoke arrangement, embodying an aspect of the invention that is mounted on a cathode ray tube.

Referring to FIG. 1, there is shown a deflection yoke 10 mounted on a neck 66 of, for example, a 31 V, 110° CRT 67 such as, for example, Thomson's A79ECU13X. Yoke 10 includes a pair of vertical deflection coils 11*a* and 11*b* toroidally wound on a magnetically permeable core 12, and a pair of, for example, conventional saddle type horizontal deflection coils 13. Coils 13 are energized with a deflection current $i_H$ at 14A p-p having the horizontal deflection frequency of $2 \times f_H$ that is approximately 32 KHZ. A plastic insulator 14 electrically and physically, but not magnetically, separates the vertical and horizontal deflection coils and may provide support and alignment structure not generally illustrated for the coils and the core. Toroidal core 12 is split into two symmetrical upper and lower halves core pieces 102*a* and 102*b*, respectively.

Figure 2:
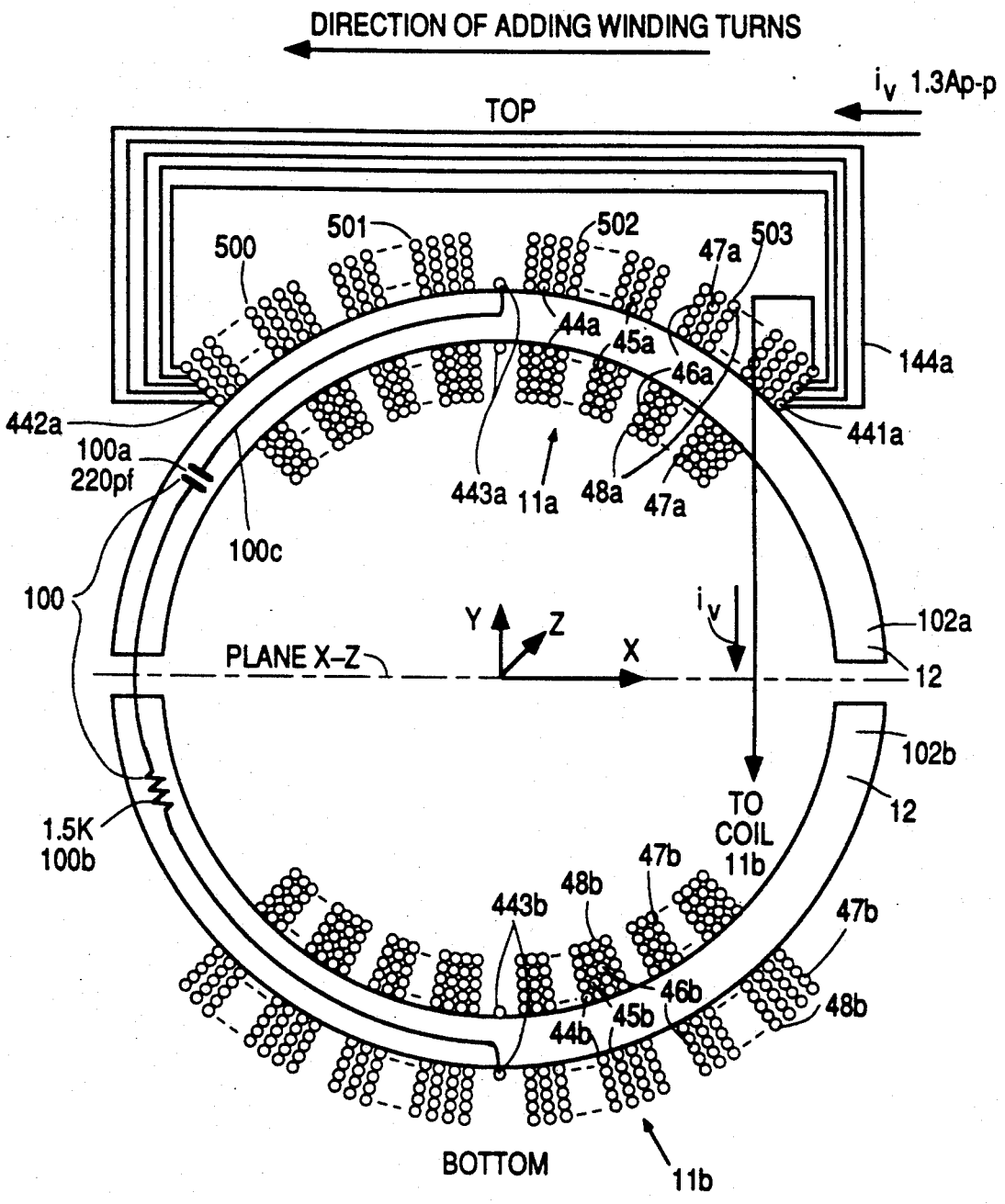
FIG. 2 illustrates a cross section of the vertical deflection coils of FIG. 1, in more detail, and a ringing suppression network, embodying an aspect of the invention.

FIG. 2 illustrates a cross section in the X-Y plane of vertical deflection coils 11*a* and 11*b* that are wound in the multiple layer winding technique. A network 100 suppresses the ringings, in accordance with an inventive feature. Similar numeral and symbols in FIGS. 1 and 2 indicate similar items or functions. Coils 11*a* and 11*b* are mounted symmetrically with respect to the plane X-Z that is defined between core pieces 102*a* and 102*b*. The interconnection of the layers in coil 11*b* is similar to that in coil 11*a*, hence, not shown in detail.

Each vertical deflection coil assembly is wound separately on a winding machine, for example, in the same manner. The machine rigidly clamps, for example, core piece 102*a* of FIG. 2, with the longitudinal axis of the core oriented in a vertical direction. The flyer of the winding machine, to which one end of a spool of a conductor wire is attached, is indexed in a horizontal direction until the starting position of a first layer 44*a* of conductor turns is reached. To reduce the skin effect at the higher horizontal deflection frequency, the conductor wire of the spool includes seven wire strands. Each winding turn of the vertical deflection coil may be formed simultaneously from the seven wire strands.

The flyer begins to wind around the core piece and continues winding in the same angular direction around the core piece, as shown by the arrow, until first layer 44*a* is completely wound. The wire is then returned backward, by a wire portion shown in a schematic manner in FIG. 2 and referred to by reference numeral 144*a*, for example, close to the same starting point of the first layer 44*a*, for winding the next winding layer, 45*a*. Each of the last three winding layers, 46*a*–48*a*, of coil 11*a* is wound in a similar way. The result is that each of the toroidally wound vertical deflection coils on each core piece, 102*a* and 102*b*, of magnetically permeable core 12 comprises five winding layers.

The individual winding layers, 44*a*–48*a*, for example, of coil 11*a* may occupy or subtend different winding angles or arcuate regions on the core in order that the vertical deflection field produced by the deflection coils provided the desired degree of field nonuniformity that may be necessary to, for example, converge the electron beams.

As indicated before, the coil on each core piece is wound in a continuous fashion with a given layer being completely wound before a subsequent layer is begun. As explained in U.S. Pat. No. 4,511,871, in the names of Schier, Jr. et al., entitled MODIFIED DEFLECTION YOKE COILS HAVING SHOOTBACK WINDINGS, that is incorporated by reference herein, after a given layer is completely wound, the wire may be returned to the starting point for winding the next winding layer in, for example, the well known shootback method.

In accordance with an aspect of the invention, R-C, ringing suppression or damping network 100 is coupled between a pair of winding turns 443*a* and 443*b*. Winding turn 443*a* is located between end winding turns 441*a* and 442*a*, such as, for example, half way through, or in the middle of winding layer 44*a*. Winding layer 44*a* is wound closer to core piece 102*a* than any of the other winding layers, 45*a*–48*a*. Winding turn 443*b* is analogous to winding turn 443*a*. Winding turn 443*b* is located in the first winding layer, 44*b*, wound closer to core piece 102*b* than any of winding layers 45*b*–48*b*.

Each winding layer of coils 11*a* and 11*b* includes, for example, 80 winding turns, with a total winding turns of 400 in each of coils 11*a* and 11*b*. The winding turns in each winding layer are concentrated mainly in four bundles 500–503 such that between the bundles the winding concentration density is substantially smaller than within the bundle. Each bundle in a given layer contains approximately 20 winding turns to form the total of 80 winding turns in the layer. The winding turn density of each of, for example, layers 45*a*–48*a* may be made, for example, smaller in the vicinity of winding turn 443*a*, so as to expose winding turn 443*a* to the outside of yoke 10. By so exposing winding turn 443*a*, and access is provided to attach a lead 100*c* of network 100, for example, by soldering lead 100*c* to winding turn 443*a*, after coil 11*a* has been already wound.

Network 100 includes a capacitor 100*a* coupled in series with a ringing attenuating resistor 100*b*. Capacitor 100*a* forms a low impedance to the ringings that are at a high frequency of, for example, 1 MHZ. The value of resistor 100*b* is selected to provide, for example, critical damping of the ringings.

Figure 3:
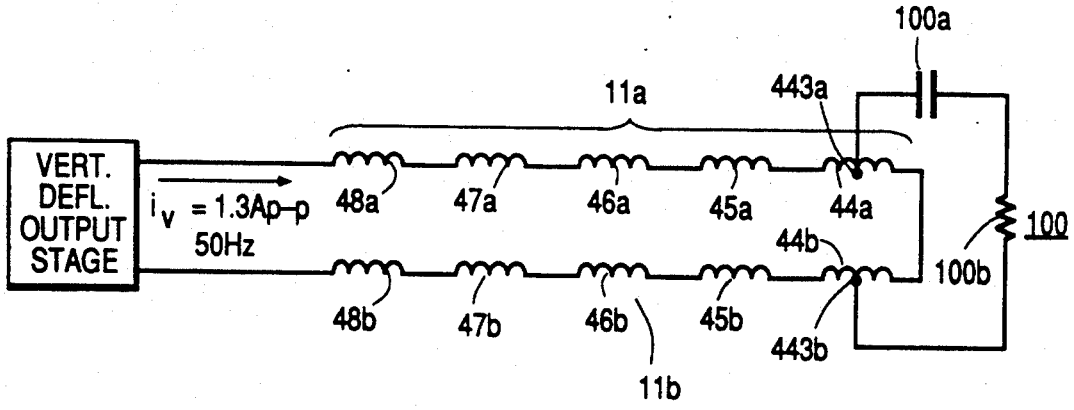
FIG. 3 illustrates the way the ringings suppressing network and the winding layers of the vertical deflection coils of FIG. 2 are coupled.

FIG. 3 illustrates a schematic interconnection between the layers of coils 11*a* and 11*b* and network 100. Similar symbols and numerals in FIGS.1-3 indicate similar items or functions. As shown in FIG. 3, network 100 is coupled between winding turns 443*a* and 443*b* of winding layers 44*a* and 44*b*, respectively.

Advantageously, by providing ringing attenuating network 100 that is coupled to coils 11*a* and 11*b*, wound in the multiple layer winding technique, ringings in coils 11*a* and 11*b* are significantly reduced. Such arrangement is particularly effective for reducing the ringings when frequency substantially higher than $f_H$, such as $2 \times f_H$.

What is claimed is:

1. A deflection yoke for producing electron beam scanning in a cathod ray tube of a video display, comprising:

a core made of a permeable magnetic material;

a toroidal, first vertical deflection coil cooperating with said core for producing a vertical deflection field, said first vertical deflection coil having a plurality of winding layers wound around said core in a multiple layer winding technique;

a horizontal deflection coil for producing a horizontal deflection field; and a ringing suppressing impedance coupled to an intermediate terminal between end winding turns of a winding layer of said first vertical that is remote from a center winding layer of said first vertical deflection coil for suppressing ringings that are produced in said first vertical deflection coil by said horizontal deflection field.

2. A deflection yoke according to claim 1 wherein said ringings are initiated in said first vertical deflection coil during horizontal retrace.

3. A deflection yoke according to claim 1 wherein a first terminal of said impedance is coupled between end winding turns of a first winding layer wound closer to said core than each of the other winding layers of said plurality of winding layers.

4. A deflection yoke according to claim 3 further comprising, a second vertical deflection coil having a second plurality of winding layers wound in the multiple layer winding technique, wherein a second terminal of said impedance is coupled to a second intermediate terminal, between end winding turns of a winding layer of said second vertical deflection coil that is wound closer to said core than each of the other winding layers of said second plurality of winding layers.

5. A deflection yoke according to claim 4 wherein said first and second vertical deflection coils are wound around upper and lower halves of said core, respectively, to form a toroidal vertical deflection coil.

6. A deflection yoke accroding to claim 1 wherein said impedance comprises a resistor coupled in series with a capacitor that form a series arrangement coupled between said first and second vertical deflection coils.

* * * * *